US009834230B2

(12) United States Patent
Agahi et al.

(10) Patent No.: US 9,834,230 B2
(45) Date of Patent: Dec. 5, 2017

(54) HOPPER CAR DISCHARGE STRUCTURE

(71) Applicant: NATIONAL STEEL CAR LIMITED, Hamilton (CA)

(72) Inventors: Maryam Agahi, Burlington (CA); Jamal Hematian, Burlington (CA)

(73) Assignee: National Steel Car Limited (CA)

( * ) Notice: Subject to any disclaimer, the term of this patent is extended or adjusted under 35 U.S.C. 154(b) by 175 days.

(21) Appl. No.: 14/722,315

(22) Filed: May 27, 2015

(65) Prior Publication Data

US 2016/0347331 A1 Dec. 1, 2016

(51) Int. Cl.
*B61D 7/04* (2006.01)
*B61D 7/18* (2006.01)
*B61D 7/24* (2006.01)

(52) U.S. Cl.
CPC ..... *B61D 7/04* (2013.01); *B61D 7/18* (2013.01); *B61D 7/24* (2013.01)

(58) Field of Classification Search
CPC ... B61D 7/00; B61D 7/02; B61D 7/04; B61D 7/06; B61F 1/00; B61F 1/02; B61F 1/04; B61F 1/08
See application file for complete search history.

(56) References Cited

U.S. PATENT DOCUMENTS 1,300,959 A 4/1919 Hart
3,104,623 A 9/1963 Dorey
3,242,878 A 3/1966 Floehr
3,256,836 A * 6/1966 Floehr ..... B61D 7/26 105/248
3,316,857 A 5/1967 Floehr
3,608,500 A 9/1971 Floehr
4,194,450 A 3/1980 Miller
4,741,274 A 5/1988 Ferris et al.
4,766,820 A 8/1988 Ritter et al.
4,829,908 A 5/1989 Hallam
4,884,511 A 12/1989 Hallam et al.
5,249,531 A 10/1993 Taylor
6,302,031 B1 10/2001 Smith et al.
6,604,469 B1 8/2003 Galvan et al.
7,703,397 B2 4/2010 Forbes et al.
8,356,560 B2 1/2013 Forbes et al.

* cited by examiner

*Primary Examiner* — R. J. McCarry, Jr.
(74) *Attorney, Agent, or Firm* — Hahn Loesser & Parks LLP

(57) ABSTRACT

A bottom discharge open topped hopper car has a center sill with a bottom flange having laterally protruding edges. A shed plate assembly is provided to discourage accumulation of product on the exposed upwardly facing shelf otherwise presented by the bottom flange protrusions. The shed plate assembly may be mounted to the center sill in a manner that avoids impairment of the stress performance of the flanges of the center sill, whether by mechanical fastenings to other objects, or welding to objects that are not the center sill. The shed plate assembly may have walls having upper margins that are higher than the upper extremity of the hopper discharge opening such that the shelf of the center sill bottom flange is in the lee of, or sheltered by, the shed plate. The lading may thereby move under the influence of gravity past the shed plate to its desired unloading receptacle.

22 Claims, 12 Drawing Sheets

HOPPER CAR DISCHARGE STRUCTURE

FIELD OF THE INVENTION

This invention relates to the field of railroad freight cars and to discharge apparatus for railroad freight cars.

BACKGROUND

In the North American railroad industry, bottom dumping gondola cars and open top hopper cars are frequently used. In more recent times standards for contamination of lading have risen, such that it may be desirable to take steps to prevent traces of lading from one car load being transported with the car when it is filled with subsequent lading.

Quite separately, where the lading may be corrosive, or may tend to attract or retain moisture, it may be desirable to take steps to discourage accumulation of lading on upward facing surfaces adjacent to the discharge section of the car.

It may also be desirable to take such steps without giving rise to unintended consequences in terms of the structural integrity, durability, service life or performance of the car over its operating life.

SUMMARY OF THE INVENTION

In an aspect of the invention, there is a structure for a bottom dumping railroad hopper car. The hopper car may have at least a first hopper, that first hopper having a downwardly opening discharge section, the discharge section having an opening through which to discharge lading, the opening having a periphery. The structure has a center sill, the center sill having at least one shear web and at least one flange. The shear web stands upwardly of the flange. The flange has a margin extending laterally outboard of the web. The structure includes a wall member that extends upwardly of the margin of the flange. The wall member is located between the flange and the periphery of the discharge opening. At least the majority of the margin of the flange is located in the lee of the wall member.

In a feature of that aspect of the invention, the wall member extends from a height below the periphery of the discharge section opening to a height higher than at least a portion of the periphery of the discharge opening. In another feature, the wall member has an upper margin, and the upper margin of the wall member lies at a greater height than an uppermost portion of the periphery of the opening. In still another feature, the wall member extends from a height below at least a portion of the periphery of the discharge section opening to a height that is above all of the periphery of the discharge opening. In a further feature, substantially all of the flange adjacent to the hopper discharge section is sheltered behind the wall member. In a still further feature, the flange has an outermost distal tip most laterally outboard of the web, and the wall member extends outboard of the distal tip. In yet another feature, the wall member is secured in place other than by weldment to the center sill. In an additional feature, the wall member is secured in place without attachment to the center sill. In still another feature, the wall member is secured to the discharge section of the hopper. In again another feature, the wall member has a curved upper margin that seats about a service delivery conduit. In a yet further feature, at least a portion of the wall member is maintained in position by a retainer that extends at least partially underneath the center sill.

In another aspect of the invention there is a railroad hopper car. It has at least a first hopper. That first hopper has a downwardly opening discharge section. The discharge section has an opening through which to discharge lading. The opening has a periphery. The car has a center sill. The center sill has at least one shear web and at least one flange. The shear web stands upwardly of the flange. The flange has a margin extending laterally outboard of the web. The car has a wall member that extends upwardly of the margin of the flange. The wall member is located between the flange and the periphery of the discharge opening. At least a majority of the margin of the flange being located in the lee of the wall member.

In a feature of that aspect, the wall member extends from a height below the periphery of the discharge section opening to a height higher than at least a portion of the periphery of the discharge opening. In another feature, the wall member has an upper margin, and the upper margin of the wall member lies at a greater height than an uppermost portion of the periphery of the opening. In still another feature, the wall member extends from a height below at least a portion of the periphery of the discharge section opening to a height that is above all of the periphery of the discharge opening. In yet another feature, all of the flange adjacent to the hopper discharge section is sheltered behind the wall member. In a further feature, the wall member is secured in place other than by weldment to the center sill. In still a further feature, the car has is one in which at least one of: (a) the wall member is secured in place without attachment to the center sill; (b) the wall member is secured to the discharge section of the hopper; and (c) the wall member has a curved upper margin that seats about a service delivery conduit. In another feature, at least a portion of the wall member is maintained in position by a retainer that extends at least partially underneath the center sill.

In still another feature, the wall member has the form of a plate having an angle formed therein such that the wall member has a first portion and a second portion. The first portion defines a first flange of the wall member for engagement with the flange of the center sill, and the flange of the wall is positioned one of (a) on an upper surface of the flange of the center sill; and (b) to curl around the flange and extend at least partially therebelow. The second portion extends upwardly from the first portion, and the second portion has an upper margin that is one of (a) mounted to a portion of the discharge section at a height above any uppermost portion of the periphery of the discharge opening; (b) secured to the center sill other than by welding; (c) is formed to seat about a services conduit; and (d) is formed into a second flange such that the overall member has a channel form, and said second flange is secured to structure other than the center sill.

It may be understood that the various aspects and features may be mixed and matched as may be appropriate. It may also be understood that the foregoing is not intended to be an exhaustive listing of aspects and features of the invention. These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
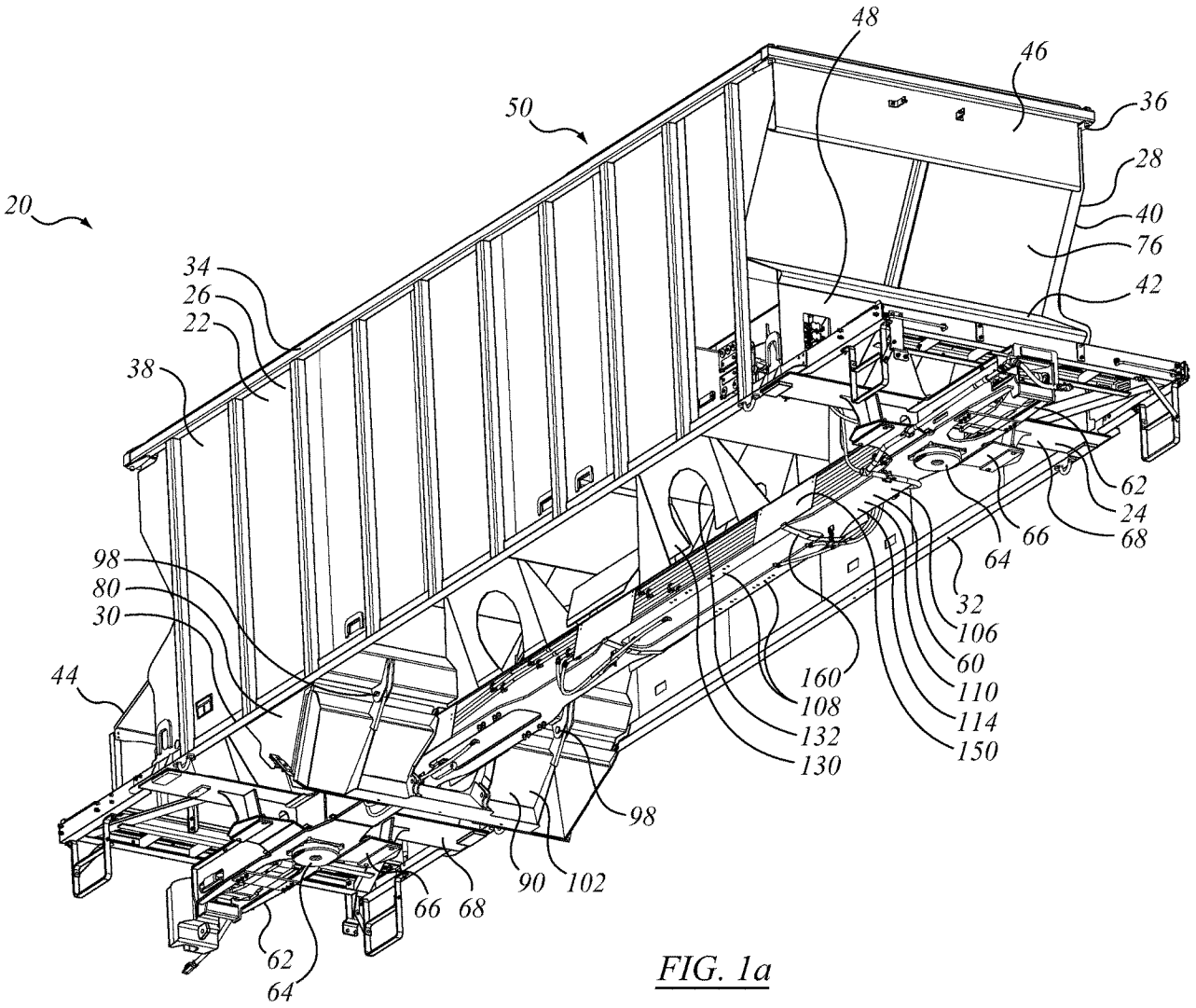
FIG. 1*a* is an isometric view of a railroad hopper car body shown from below, to one corner and to one side, with most hopper sheets and gate mechanisms removed to expose structure.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as they would be understood by a person of ordinary skill in the railroad industry in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the railroad industry in North America or in other former territories of the British Empire and Commonwealth.

In terms of general orientation and directional nomenclature, for railroad cars described herein the longitudinal or lengthwise direction is defined as being coincident with the rolling direction of the railroad car, or railroad car unit, when located on tangent (that is, straight) track. In the case of a railroad car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the terms cross-wise, lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than". The directions correspond generally to a Cartesian frame of reference in which the x-direction is longitudinal or lengthwise, the y-direction is lateral or cross-wise, and the z-direction is vertical. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, if used, the abbreviation ksi stands for thousands of pounds per square inch. Also, it may be taken as a default that the structure of the car is of all-welded mild steel fabrication except as otherwise shown in the illustrations or indicated in the text. This need not necessarily be the case. Other materials, such as aluminum or stainless steel might be used.

In this discussion it may by understood that persons of ordinary skill in the art are familiar with the Rules and Standards of the Association of American Railroads (the AAR), which govern interchange service in North America. This specification or the accompanying illustrations may refer to standards of the AAR, such as to AAR plate sizes. To the extent necessary or appropriate, those references are to be interpreted in a manner consistent with the Rules and Standards as extant on the earliest of the date of filing of this application or the date of priority of the earliest application from which this application claims priority, as if they formed part of this specification on that date.

By way of a general overview, as shown and described herein, open top hopper cars may have box type center sill construction, the box being formed of two spaced apart vertical webs that join upper and lower flanges. The edges of the flanges may extend outboard beyond the vertical shear webs to form a shelf or ledge. In one embodiment, the bottom flange shelf or ledge may extend about 4" past the shear webs. For pneumatic operation of the doors, pipes may run along the outside faces of the center sill webs on both sides of the car. Various pipe arrangements are possible on either side of the car. Near the hopper door areas, the ledge or shelf of the protruding flange may provide an upwardly facing surface upon which product may hang up when the car is unloaded. This event creates a potential contamination problem with the next loading.

As shown and described herein, an inclined plate, which may be termed a "shed plate", may be positioned to hang from pipes running along the center sill web, with the object of sheltering the ledge or shelf and discouraging, or eliminating hang up of product. In one embodiment, the plate may have a bent short face that lies on top of the bottom flange. The shed plate fastening arrangement may vary depending on the number of pipes that are mounted to the center sill behind each plate. Where spacing between the pipes allows, the shed plate may be positioned behind the uppermost pipe. Otherwise, the plate may be attached to the front of the pipe i.e., laterally outboard of the pipe. By adding an inclined shed plate, lading material may tend not to have the opportunity to hang up on the bottom flange. This may aid in preventing product contamination, and may also tend to reduce the amount of time used in cleaning off the material, and the car, after each unloading. By hanging an inclined plate from pipes running along the center sill web, the commodity is guided and material hang up on the bottom flange may be reduced or eliminated when unloading the car and the potential contamination problem with the next loading may be avoided. The shed plate may be a robust and permanent application tending to improve overall car performance for the user.

Material hang up may sometimes otherwise tend to be ignored. Alternatively, it may be removed from the ledge by an operator using a water hose, or possibly an air hose. It may generally not be desirable to ignore the possibility of product contamination, and it may not be desirable to use water—either because the commodity itself needs to be kept dry, or because the presence of water may tend to cause other problems such as may occur due to freezing or due to corrosion. Air may also be problematic where it is undesirable to raise dust, or to spread the hung up material indiscriminately; or, where the lading is dense particulate material, air may not be satisfactorily effective, or may entrain particles undesirably.

Commencing with FIG. 1*a*, a railroad freight car body is shown generally as 20. In the embodiment shown the railroad car body is the body of an open topped hopper car. Generally there is an upstanding wall structure indicated as 22, and an underframe structure 24. The upstanding wall structure includes lengthwise or longitudinally running first and second side walls 26, 28, which may have left and right hand side sills 30, 32 and top chords 34, 36, and side sheets 38, 40 extending as shear panels therebetween, with upstanding side wall stiffeners spaced along the side sheets to run between the side sills and top chords. Each set of a side sill, shear web side sheet and top chord may function as a deep beam. Car body 20 may include respective near and far end sections 42, 44 which may include end walls 46 supported by laterally extending end stub walls 48. As may be understood, the side walls 26, 28 and end walls 46 may co-operate to define a lading carrying or lading holding receptacle, or vessel, or container, nominally designated as 50, in which lading may be transported. That holding receptacle may be open at the top, and bounded peripherally by the respective top chords of side walls 26, 28 and end walls 46 that, together, define the opening 52 to the car through which lading may be introduced. Lading may exit car body 20 through bottom outlets, or discharge openings, 100.

Underframe structure 24 may include a straight-through center sill 60 having near and far end draft sills 62 and truck centers 64. Center sill 60 may run the full length of the car from end to end. Main bolsters 66 extend laterally from center sill 60 at the locations of the truck centers underlying stub wall 48. Main bolster 66 may be stub bolsters, with the bending moment carried from (or to) side sills 30, 32 by the laterally extending top flange 68 of bolster 66.

Car body 20 may also include at least one hopper. In the illustration shown, hopper car 20 may have three hoppers 70, 72, 74 that share the volume of container 50. Each hopper is bounded laterally by side walls 26, 28, and longitudinally by respective first and second (or fore-and-aft) slope sheets. These slope sheets may also be designated as end slope sheets 76 that run upwardly and longitudinally outwardly to meet the angled-in upper ends of stub walls 48 and end walls 46 of end section 42; and intermediate or internal, or interior slope sheets 78 that angle upward and longitudinally inboard to toward the next adjacent hopper. As is typically the case, the hoppers may have a downwardly convergent V-shape or inverted pyramid shape. In a car of this nature, the laterally extending slope sheets function not only as a funnel that supports and then directs lading to the outlet, but also as shear webs extending across the car between the side sheets of the side walls, giving the car body stability between the side walls, acting as shear transfer members when the car is being conducted around a curve, for example.

In this description, hoppers 70, 72, 74 are downwardly opening, or bottom opening hoppers, which is to say that they are unloaded by permitting egress of the lading downwardly out of container 50 under the influence of gravity. In that sense the cars are "flow through" hopper cars. To that end, each hopper, be it 70, 72, or 74 has a discharge section 80, which is located at the bottom of the V-shape. The discharge section may include slope sheet lower margins or extensions 82, 84, such as may extend from the intermediate or end slope sheets, respectively, as may be; and inboard and outboard side sheet extensions 86, 88, all of which may co-operate to form a four-sided convergent throat of discharge section 80. Discharge section 80 further includes a gate or door 90. Egress of lading through the throat is governed by door 90. Door 90 is movable between a first position and a second position. In the first position, which may be a closed position, door 90 obstructs, or prevents discharge of lading from its respective hopper. In the second position door 90 is deflected to a less obstructive position permitting the discharge of lading through the opening.

Each hopper may have a door, or a pair of mutually acting doors that co-operate to close the bottom opening. In the embodiment shown, each hopper 70, 72, 74 may have a single acting door, those doors being indicated respectively as 92, 94, and 96. Each may be hinged at its upper extremity as at hinge fitting, or fittings 98. The door transmission linkages are not shown.

Figure 1B:
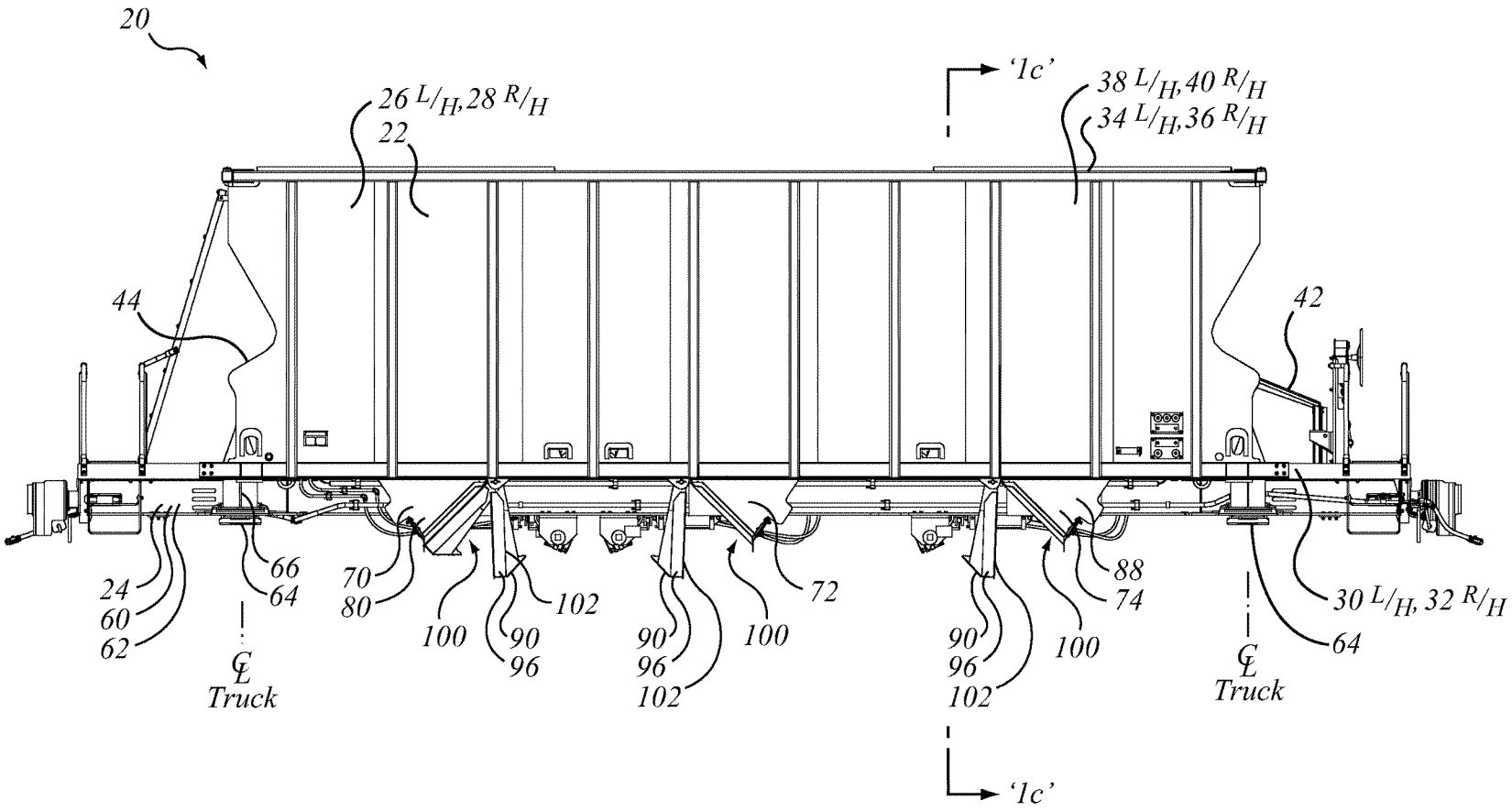
FIG. 1*b* is a side view of the railroad hopper car of FIG. 1*a;*
Figure 1C:
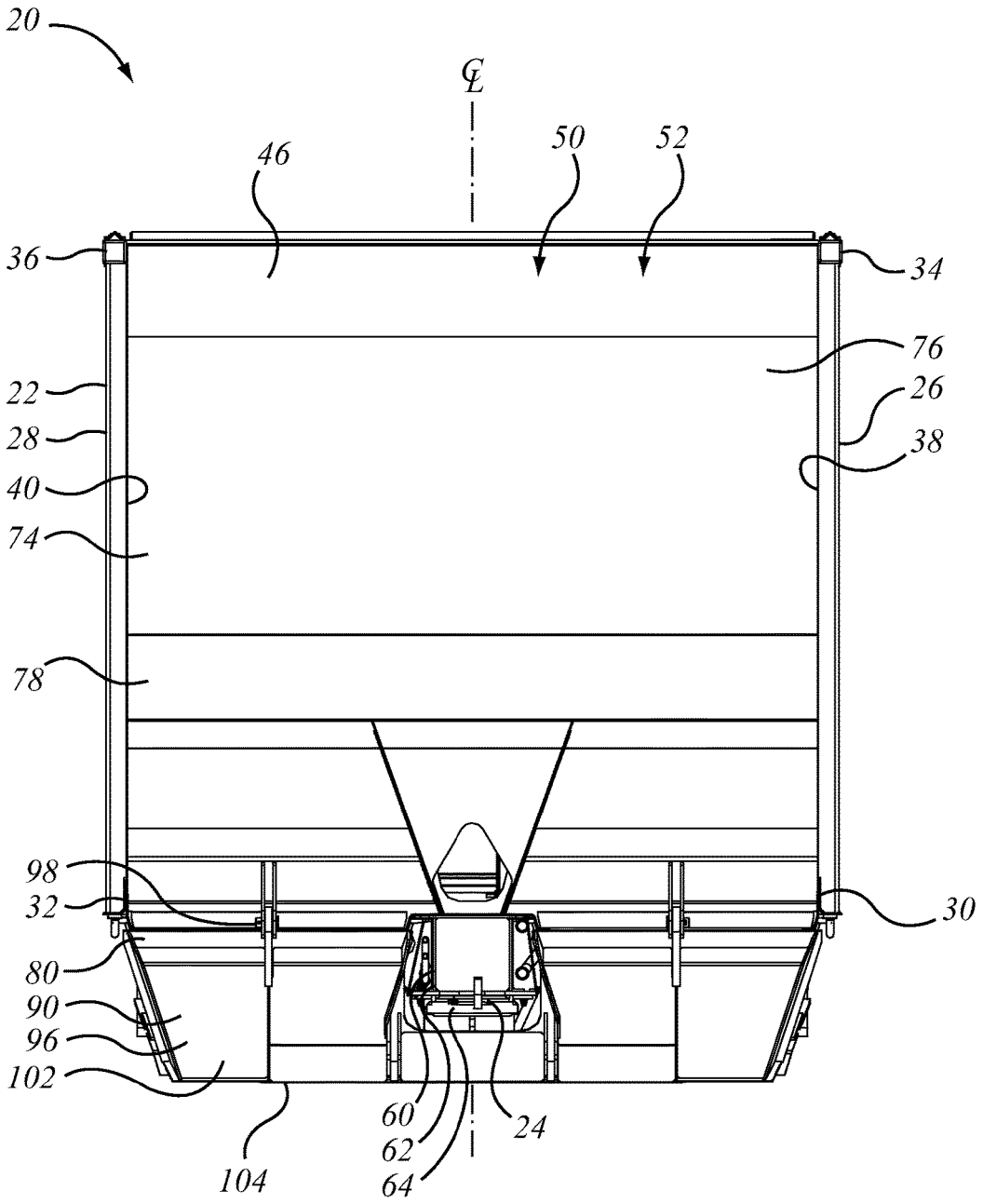
FIG. 1*c* is a cross-sectional view of the hopper car body of FIG. 1*a* taken on section '1*c*-1*c*' of FIG. 1*b* with a hopper door in the closed position.
Figure 2A:
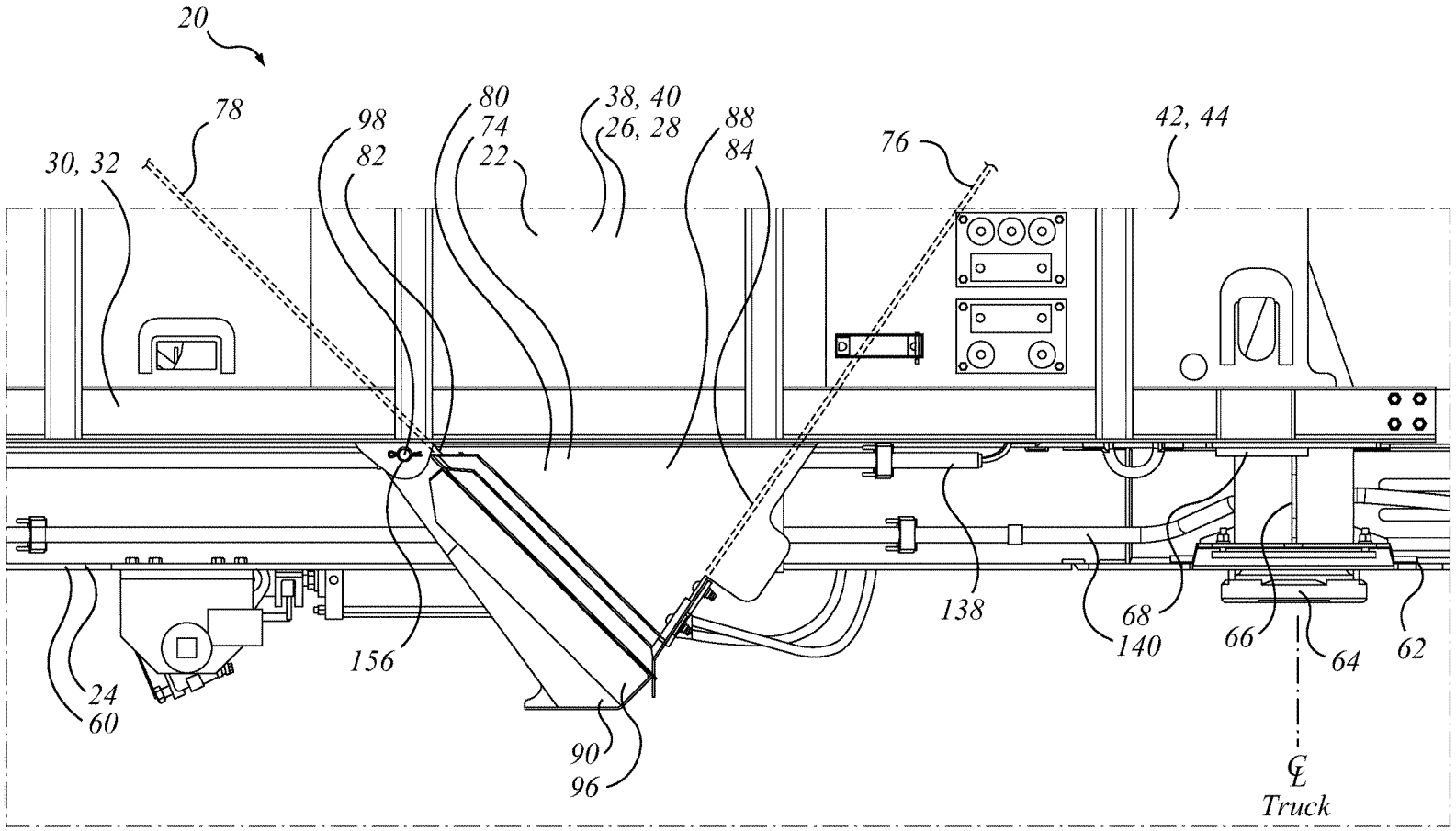
FIG. 2*a* is an enlarged detail of the side view of FIG. 1*b* with a hopper door in the closed position.
Figure 2B:
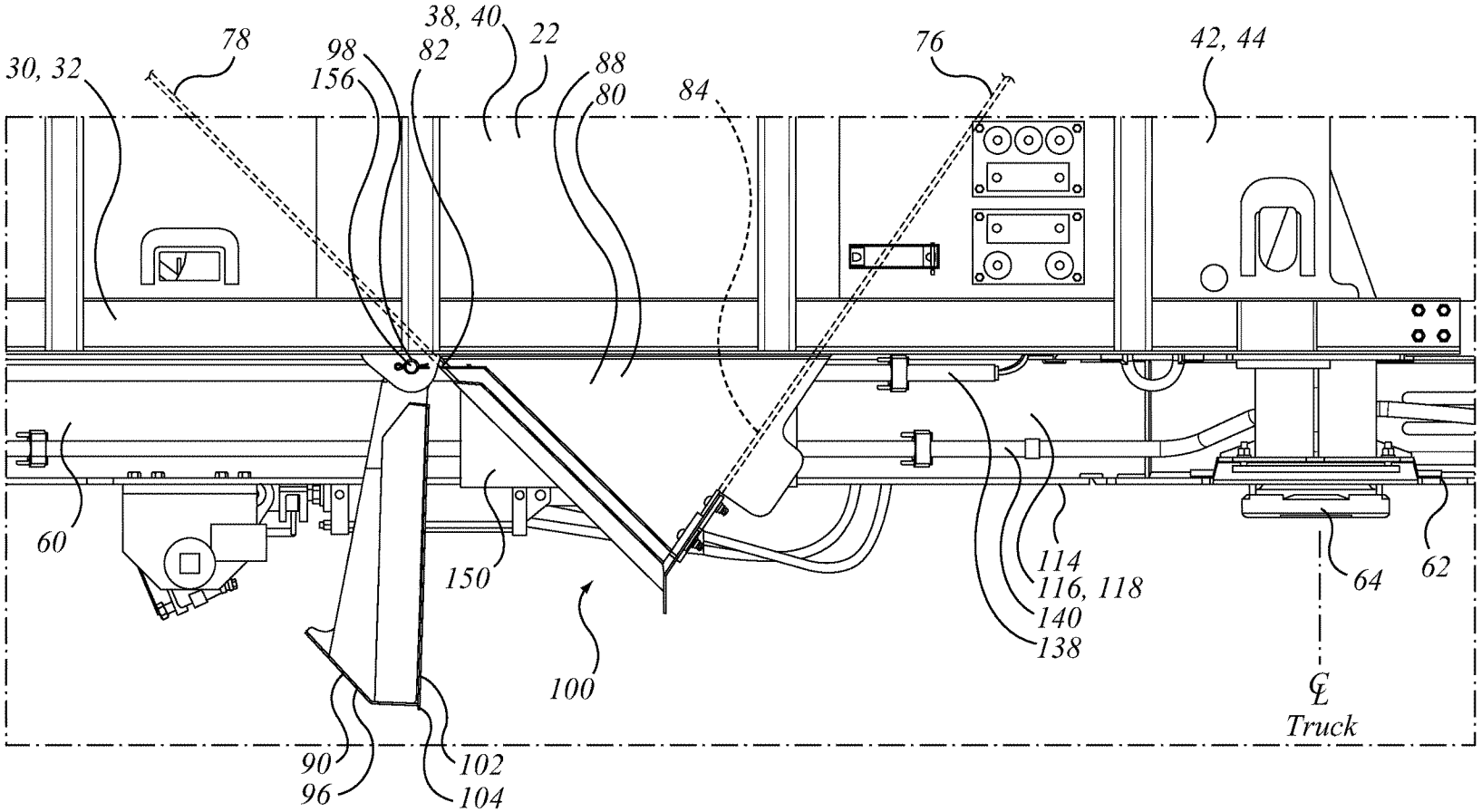
FIG. 2*b* is an enlarged detail of the hopper car body of FIG. 2*a* with a hopper door in the open position.

The co-operating lower margins of slope sheet extensions 82, 84, 86, 88 define a rim, or lip, or mouth, or periphery of the discharge opening 100 against which, or with which, door panel 102 mates in the closed position so as to prevent discharge. It may be noted from FIGS. 1*a* and 1*b* that opening 100 is not necessarily level and horizontal, but may be angled to the horizontal as indicated. That is, the top edge of opening 100 (at the hinge), and the bottom edge of opening 100 may be horizontal, and may run perpendicular to the centerline of car 20 more generally. The side edges of opening 100 may run in a plane parallel to the centerline of the car, but may be oriented on a descending angle from hinge 98 to the distal lip 104 at the lowest part of opening 100.

FIGS. 1*c*, 3*a* and 5*a*-5*h*, show a cross-section of an intermediate portion 110 of center sill 60 at a mid-car location between the trucks. In a full, straight-through center sill car, the center sill 60 may typically have a top flange or top cover plate 112; a bottom flange or bottom cover plate 114, and at least one, typically two, vertically extending spaced apart left and right hand shear webs 116, 118. In general, shear webs 116, 118 are spaced symmetrically to either side of the longitudinal centerline plane of car body 20. The flanges and webs may typically co-operate to define a closed box section. In some locations bottom flange 114 may be a solid monolith extending fully across the space between webs 116, 118 to form a closed section, as at 106, and at other locations the bottom flange may be bifurcated, i.e., split, where the flange legs 108 form angles commencing at the bottom margins of webs 116, 118, and extend laterally outwardly therefrom to form left hand and right hand toes, such that the center sill section is not closed, and access is provided to the interior. The solid and bifurcated lower flange regions may have smoothly tapering transitions into each other. The top cover-plate may have laterally outboard extending distal margins 120 that extend laterally proud of webs 116, 118. The bottom cover plate may also have flange extensions or legs, or toes, or projections 122 that extend laterally proud of webs 116, 118. In each case the projecting portion is such that a ledge or shelf 124 is defined between the laterally outermost extremity of the projection, as at 126 and the junction of web 116 or 118 with flange 114. It may be that in a car of this nature bottom flange 114 may be both thicker and wider than the top flange or top cover plate 112.

In a car of this nature, the straight-through center sill may tend to penetrate the various slope sheets that it encounters, the penetrations tending to be oblique. At some locations the slope sheets pass above the center sill; at other locations the center sill extends up into, and across, the bottom of the lading containing zone. In the regions where the center sill passes below the slope sheets, slope sheet stiffeners, sometimes called "elephant ears", namely generally triangular or trapezoidal shear webs 130, extend from a first margin or vertex running longitudinally along, and welded to the top cover plate parallel to the longitudinal centerline, to second and third margins or vertices welded to the underside of the mating intermediate slope sheets 78. The shear webs may have lightening apertures formed therein, as at 132. The space below the slope sheets may define a machinery space (or spaces) in which a door actuator, or actuators, and actuator reservoirs may be mounted. Such actuators may be pneumatic actuators connected to drive the door or doors to open and closed positions, as may be.

In the alcove formed between the upper flange overhang and the lower flange shelf, it may be that services may be run along the center sill. Those services may include mechanical drive transmission members, such as drive shafts or pneumatic or electrical conduit for carrying pressurized air or electrical cables, as may be. The pneumatic lines for transmitting power to the doors may be indicated as 134, 135, 136, 137, for example. An electrical conduit, such as to permit an externally connected electrical power source to activate the doors, is indicated as 138. Alternatively, the train line (i.e., the pipe or conduit connected through all cars to the source of compressed air at the locomotive that provides the supply of compressed air for filling the brake reservoirs and operating the brakes) 140 may run along one or other of the center sill webs.

It may not be desirable for stray lading to collect on ledge or shelf 124. Lading that collects on the shelf may contaminate subsequent discharged lading of another type. Alternatively, collected lading may also tend to encourage retention of moisture, and the consequent increase in tendency for commencement of corrosion.

It may be that the uppermost portion of the periphery of opening 100, e.g., such as along or adjacent to hinge fitting 98, lies at a height that is higher than shelf 124. In the unloading of the hopper car, the discharged lading may not necessarily flow immediately away from the discharge, but may form a tapering or slope-sided pile that builds up underneath the car before being conveyed away. As more lading tries to flow out of the hopper, the uppermost portions of that pile may back up, and may tend to flow over, and collect upon, shelf 124. To prevent this from occurring, hopper car body may have a shield, or shroud, or protector, or deflector, or plate, or wall member, or shed plate, however termed, is indicated as 150 in FIGS. 3*b* and 5*c*.

Wall member 150 may have a lower or bottom margin 152 and an upper or top margin 154 spaced upwardly and away from lower margin 152. As may be noted, lower margin 152 is positioned to shield shelf 124, or a majority of shelf 124. In the embodiment shown in Figures la, 2*b*, and 3*b*, for example, lower margin 152 is positioned against, and outboard of, the outermost outboard margin extremity 126 of shelf 124. Upper margin 154 is located at a height that is level with, or higher than, the uppermost part of the periphery of opening 100, and may be located at a height that is as high as, or higher than, the centerline $CL_{156}$ of hinge fitting 98, at hinge pins 156, and further still, in some embodiments may extend to a height as high as, or higher than, top cover plate 112. In this location, the nearest adjacent hopper discharge section structure is inboard hopper discharge side sheet extension 86. At its upper margin, extension 86 may have a flange 148 that is welded or bolted to, and that may act as a local doubler of the laterally projecting portion of top cover plate 112 lying outboard of the shear web 116 or 118. Flange 148 may be mounted on the underside of cover plate 112. Similarly, outboard side sheet extension 88 may have a flange mounted to side sill 30 or 32, as may be.

In each of these embodiments, for lading to flow over the top edge of wall member 150 would imply that the lading is flowing uphill. Generally, particulate matter such as grain, plastic pellets, potash, ores, aggregate, and so on, may tend not to flow uphill. It may be said that wall member 150 is located between the outlet opening 100 of discharge section 80. This may be expressed alternately as shelf 124 (or in other embodiments described below, the predominant portion or majority of shelf 124) being located in the lee of wall member 150; or in the further alternative it may be said that shelf 124 is protected by, or is in the shadow of, wall member 150 relative to discharge opening 100. In this example, wall member 150 is longitudinally local. That is, wall member 150 does not run continuously along center sill 60, but rather runs only locally in the region of the respective hopper discharges, covering the longitudinal extent of the fully opened door opening of the hopper, and, in the embodiments illustrated, has a greater length to overlap the opening both fore and aft in the x-direction.

In some embodiments, upper margin 154 may be held in place by being welded to center sill 60, as, for example, to the outboard edge of cover plate 112. Similarly, lower margin 152 may be welded to the outboard edge of bottom cover plate 114, as at extremity 126. However, it may not be desirable to weld items to center sill 60. That is, it may not be desirable to weld items to the bottom flange defined by bottom cover plate 114, as a weldment may be considered to be a defect or irregularity in the structure in terms of stress analysis. The weldment or adjacent heat affected zone may be a fatigue crack initiation site, for example. Upper margin 154 may be secured to flange 148 of side sheet extension 86, whether by mechanical fasteners or by welding. In this way, installation of wall member 150 need not require additional weldments or stress field singularities (such as fastener through-holes) in the bottom flange of center sill 60, and may not require additional weldments or stress-field singularities in the top flange of center sill 60.

Additionally, or alternately, lower margins 152 may be secured in place by a laterally extending strap, or ligature, or bar, or link, or spring, or retainer 160 as shown in FIG. 1*a*. Retainer 160 has a first end 162 secured to the lower margin of a first wall member 150 on one side of center sill 60, and a second end 164 secured to the lower margin of a second wall member 150 secured to the opposite side of center sill 60. Retainer 160 may have a dog-legged or kinked form, with an intermediate bend in the middle, as at 166, and may have a spring pre-load tending to urge ends 162 and 164 to pull toward each other, thereby urging lower margins 152 of wall members 150 to seat tightly against extremities 126 of the bottom flange 114.

Figure 3A:
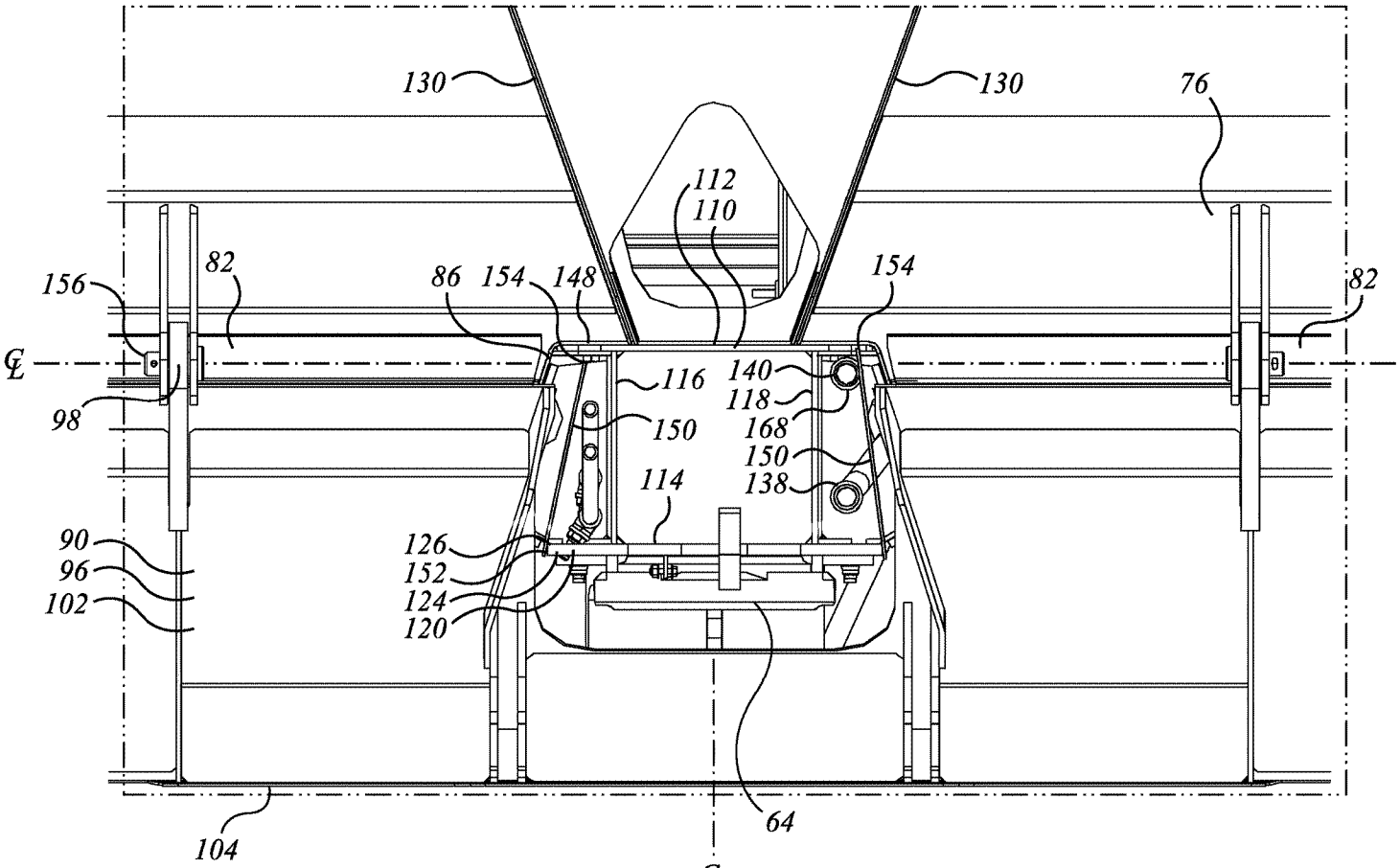
FIG. 3*a* is an enlarged detail of the sectional view of FIG. 1*c;*
Figure 3B:
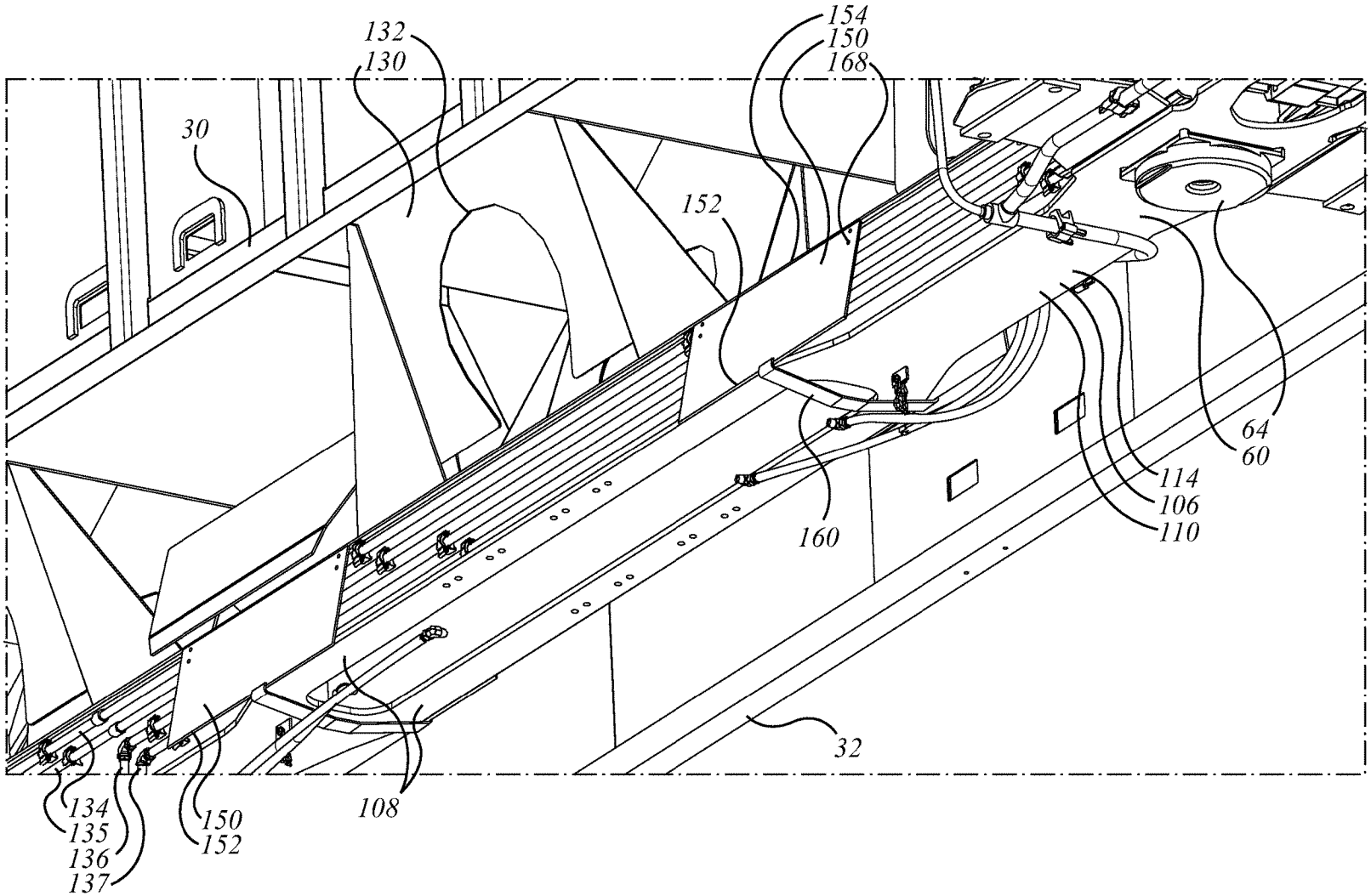
FIG. 3*b* is an enlarged detail of the isometric view of FIG. 1*a;*
Figure 5A:
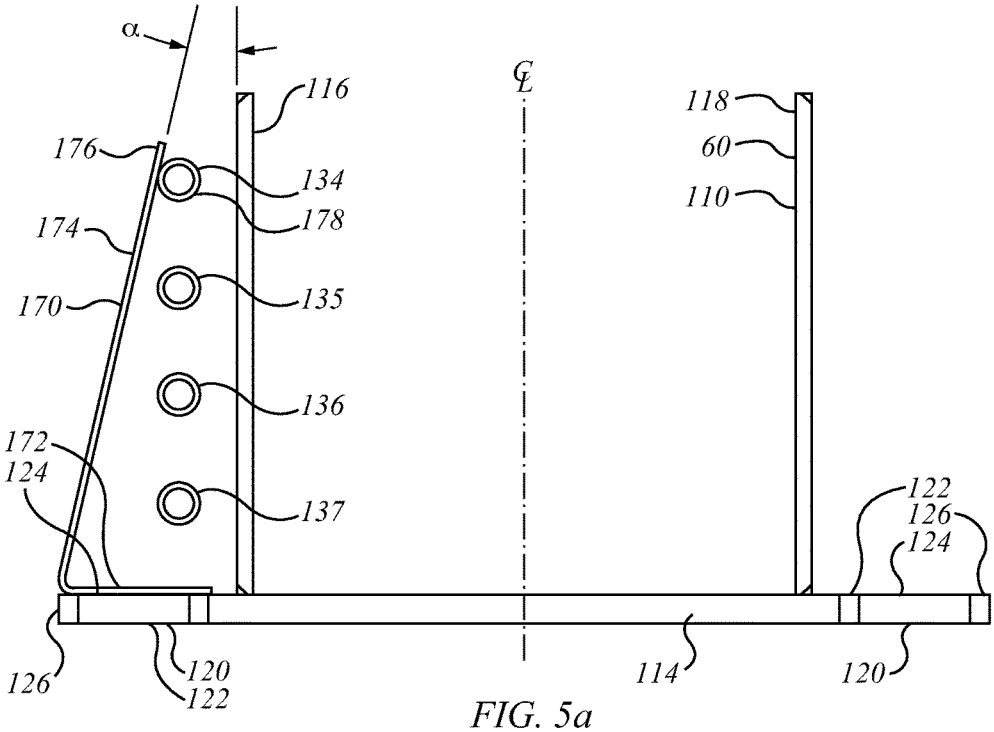
FIG. 5*a* is an alternate, and simplified, end view section to that of FIG. 3*a;*
Figure 5B:
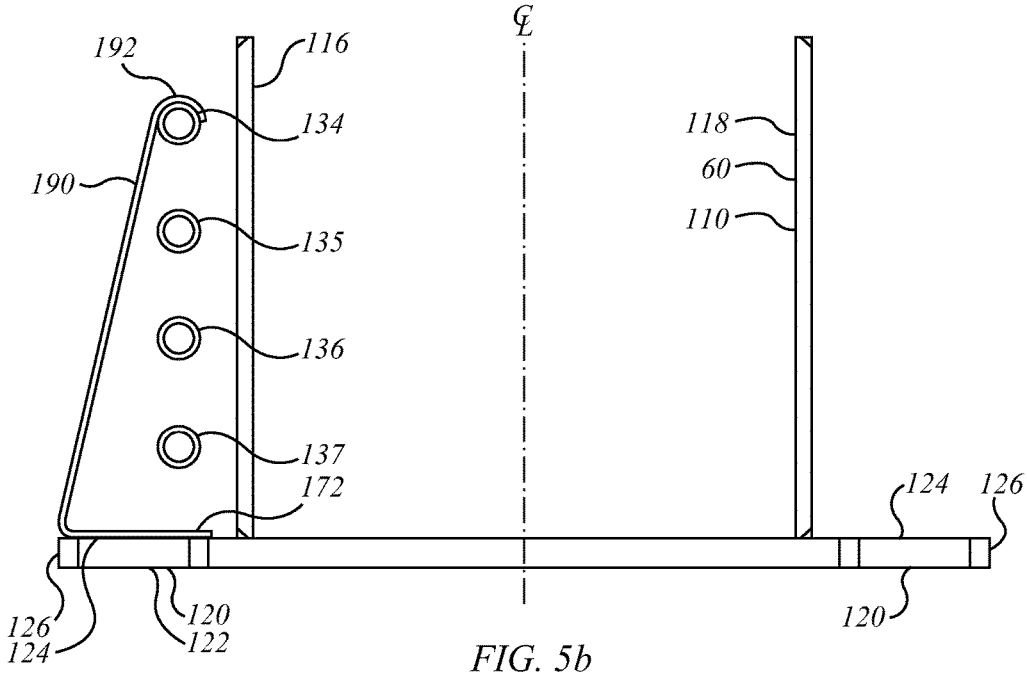
FIG. 5*b* shows an alternate section to that of FIG. 5*a;*
Figure 5C:
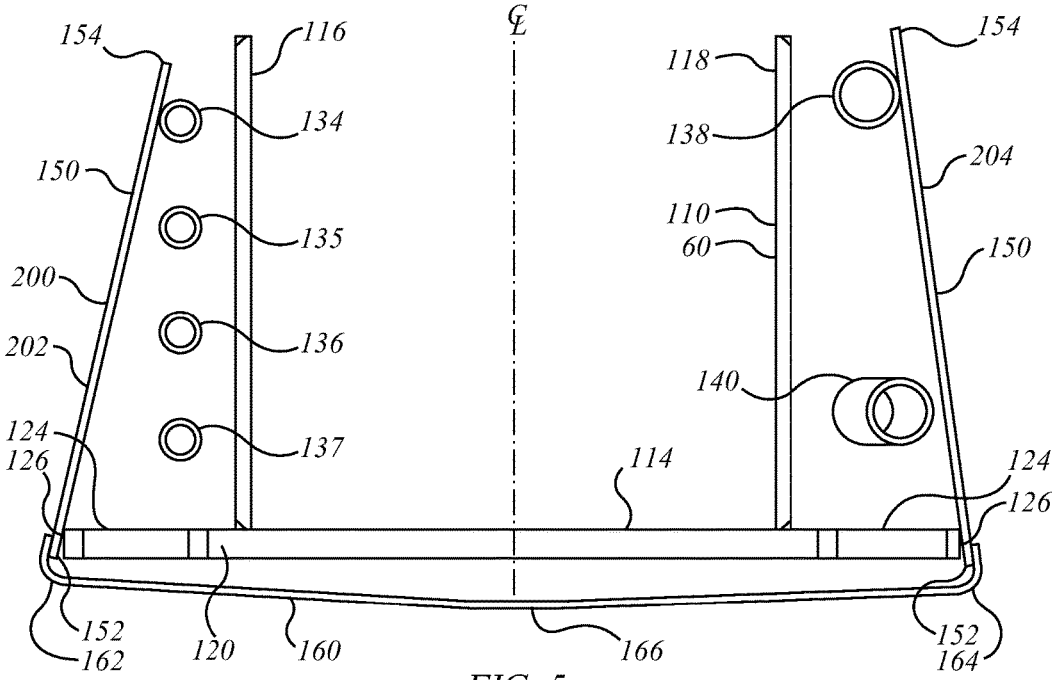
FIG. 5*c* shows a further alternate section to that of FIG. 5*a;*

In the view of FIGS. 1*a*, 3*b*, and 5*c*, wall members 150 are secured not to inboard side sheet flange 148, but to the uppermost of the longitudinally running pipes or conduits, by a mechanical fastener as at clamps or fittings 168.

Figure 4B:
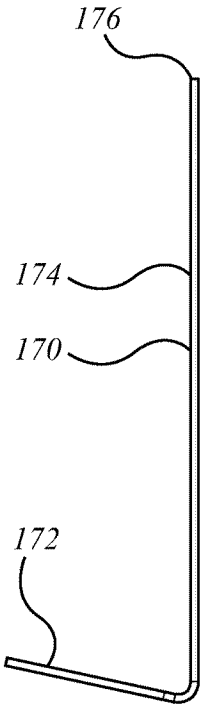
FIG. 4*b* is an end view of the shed plate of FIG. 4*a;*
Figure 4A:
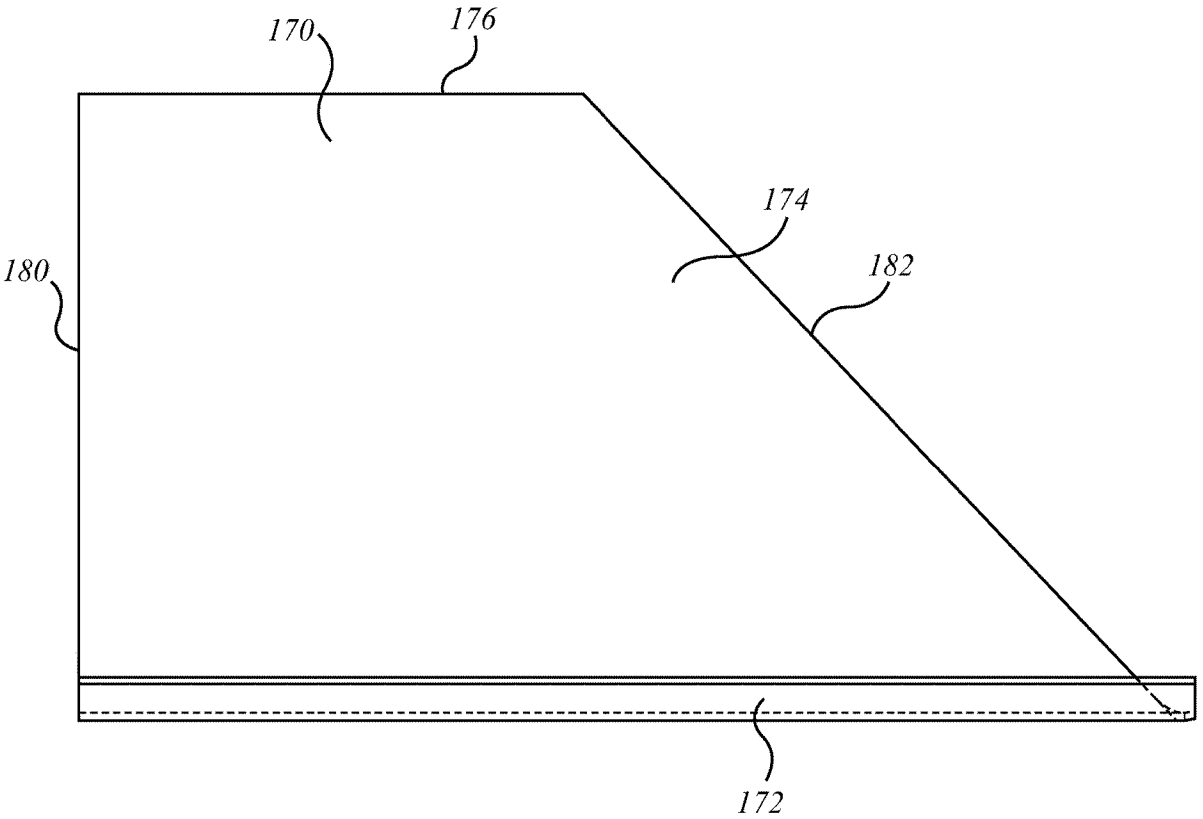
FIG. 4*a* is a side view of a shed plate for the railroad hopper car of FIG. 1*a;*

In the alternate embodiment of FIGS. 4*a*, 4*b*, and 5*a*, wall member 170 has the form of a bent plate having a short leg 172 for seating on shelf 124, and a long, upwardly extending leg 174 such as may have an uppermost margin 176 at a height higher than the opening of the door, and such as may terminate above the height of the uppermost service conduit 178. The upper edge may be a free edge, or it may be secured to conduit 178 by fittings such as fittings 168, as may be. In this embodiment, upwardly extending leg 174 may be angled inward on a diagonal angle, as suggested by angle alpha. In profile view, upwardly extending leg 174 may have a rectangular shape, as does wall member 150 as shown in FIG. 1*a* and 3*b*, or it may have a trapezoidal, or somewhat triangular, shape, as shown in FIG. 4*a*, in which vertical edge 180 corresponds to the free edge next to door 90, and oblique or diagonal edge 182 corresponds to the sloped edge of opening 100. As before, shelf 124 is located in the lee of wall member 170.

In the alternate embodiment of FIG. 5*b*, wall member 190 may be substantially the same as wall member 170 (or wall member 150), except insofar as the upper distal margin 192 is formed on a radius to curl about uppermost service conduit 178. As may be understood, although members 170 and 190 are shown only on the left hand side of center sill 60 in FIGS. 5*a* and 5*b*, it is understood that they may be applied on both sides.

Figure 5D:
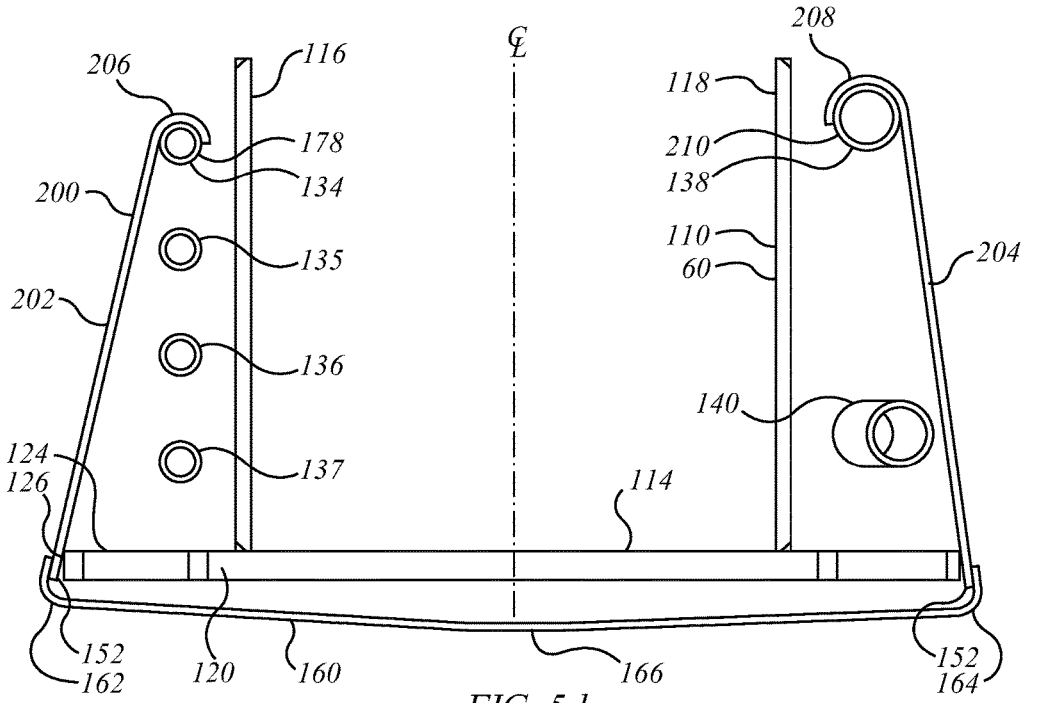
FIG. 5*d* shows another alternate section to that of FIG. 5*a;*

In the view of FIG. 5*c*, a shroud assembly or shed plate assembly 200 has first and second wall members 150 and a retainer 160 as described above. In the view of FIG. 5*d*, a shroud assembly 210 has first and second, left hand and right hand wall members 202, 204 that are substantially similar to wall members 150, but that have respective upper margins 206 and 208 that are formed on a radius to conform to the outer radius of, and to curl about, the respective uppermost service conduits 178 and 210. In this example, conduit 178 may be an air pipe, and conduit 210 may be an electrical services conduit. In this embodiment a retainer 160 attaches to the lower margins of wall members 202 and 204, as above.

Figure 5E:
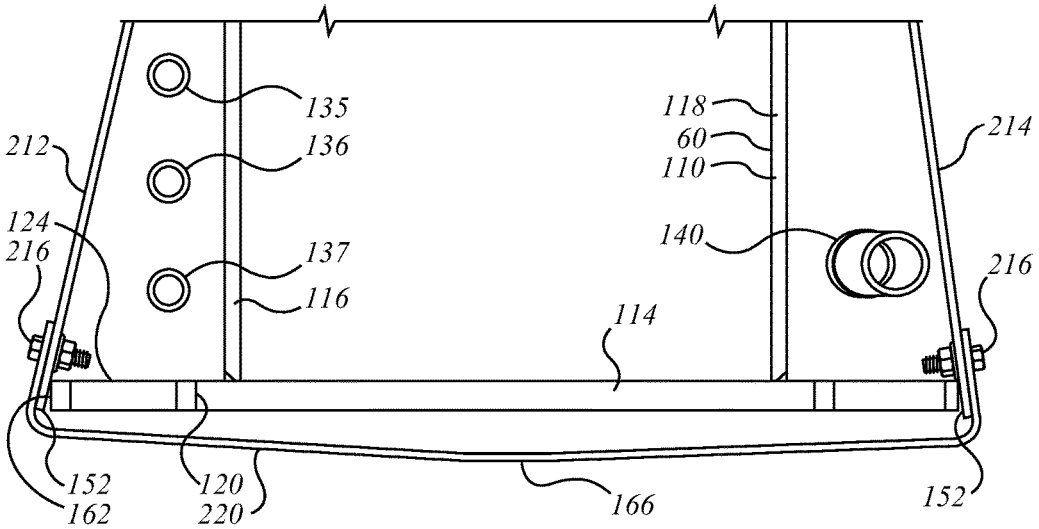
FIG. 5*e* shows another alternate section to that of FIG. 5*a;*

In the alternate embodiment of FIG. 5*e*, retainer 220 is secured to wall members 212, 214 by mechanical fasteners 216, such as bolts, rivets, or Huck™ bolts as shown. The fastener could alternatively be located below bottom cover plate 114. Retainer 220 is otherwise similar to retainer 160. The upper portions of wall members 212, 214 may correspond to one or another of wall members 150, 202 and 204.

Figure 5F:
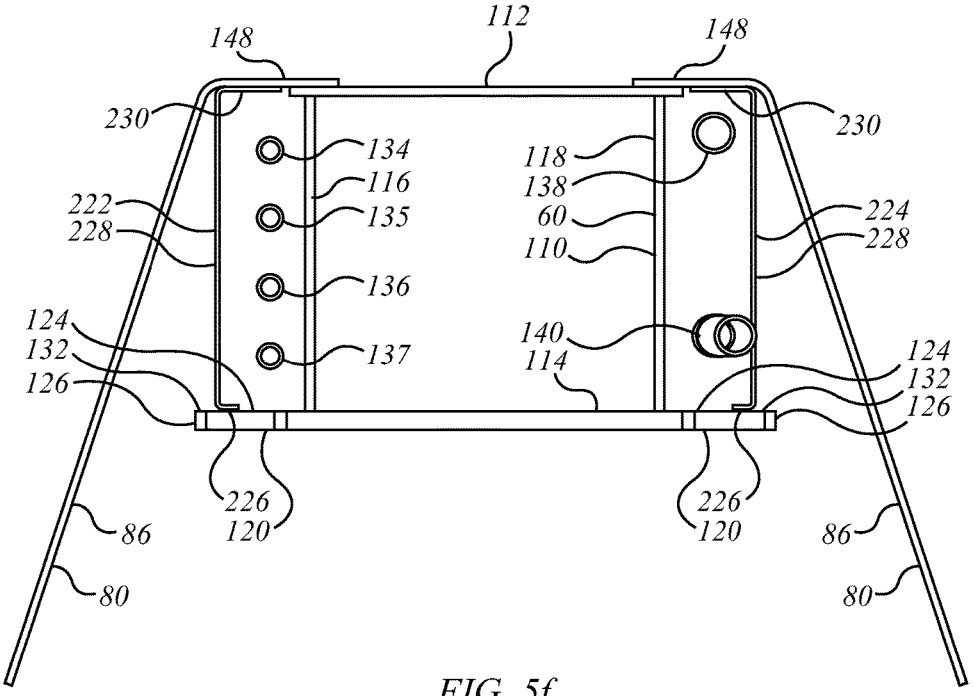
FIG. 5*f* shows another alternate section to that of FIG. 5*a;*

In the alternate embodiment of FIG. 5*f*, left hand and right hand wall members 222, 224 may have the form of formed channels having a first or short leg or toe 226 that seats upon shelf 124, a substantially vertical web or sheet 228 that extends upwardly from the outboard margin of toe 226, and a second, or long leg 230 that seats against, and may be affixed to, the underside of inboard side sheet flange 148 that overlaps top cover plate 112. In this embodiment, in side view members 222, 224 may have either a rectangular shape, as shown in FIG. 3*b*, or a trapezoidal shape as shown in FIG. 4*a*.

Figure 5G:
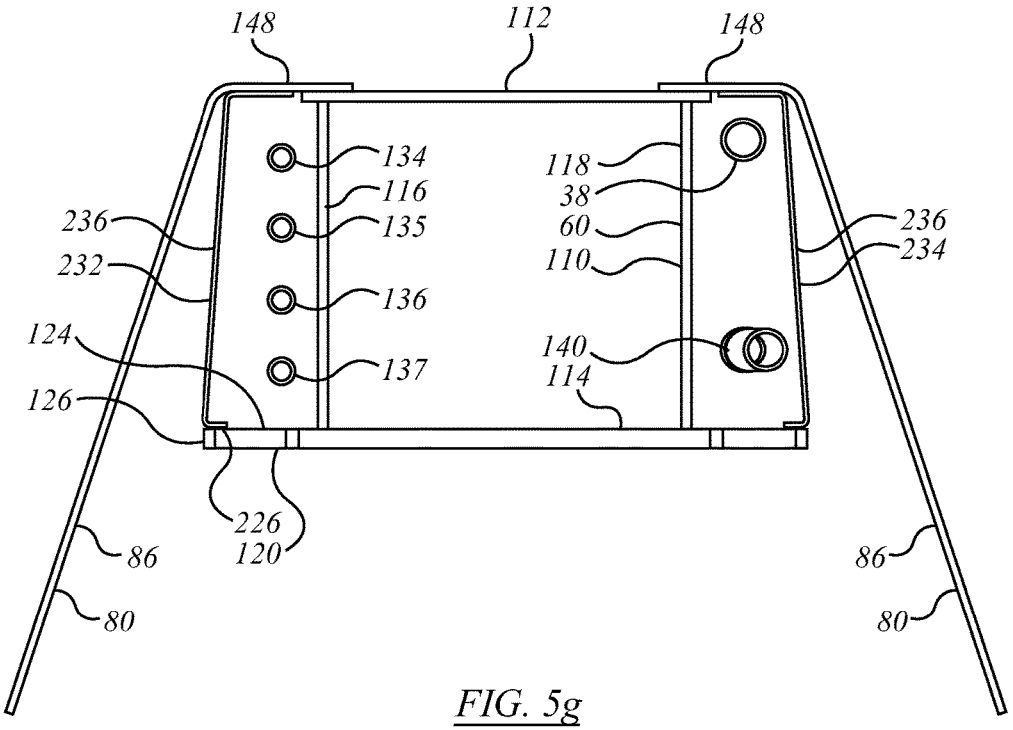
FIG. 5*g* shows another alternate section to that of FIG. 5*a*.
Figure 5H:
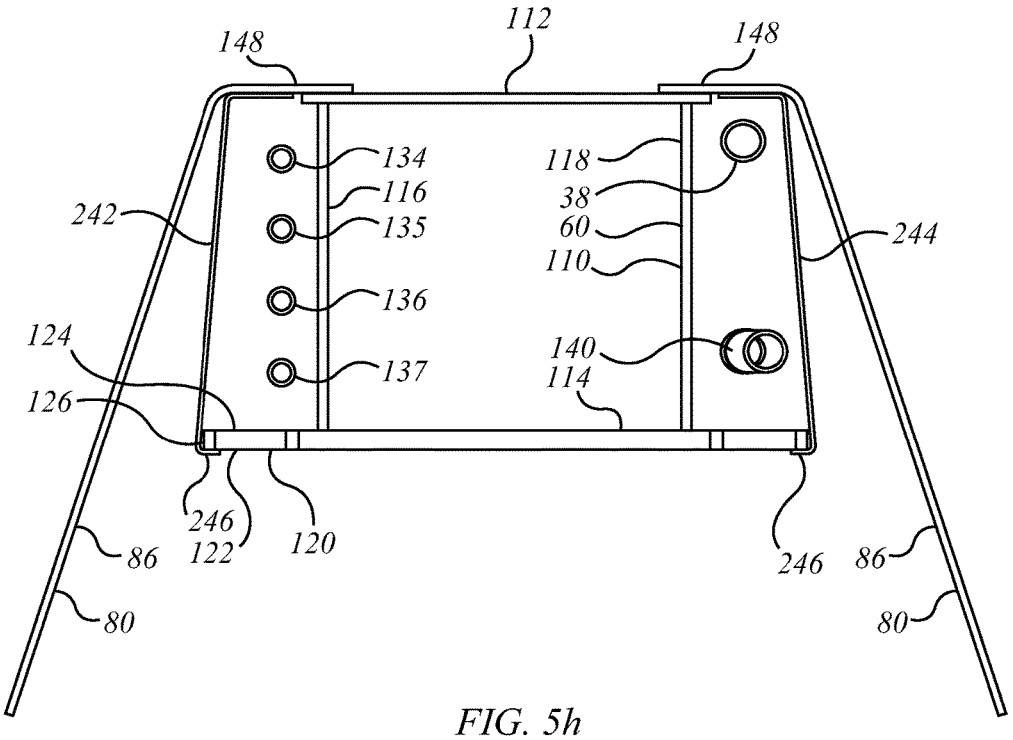
FIG. 5*h* shows another alternate section to that of FIG. 5*a*.

The embodiment of FIG. 5*g* is substantially similar to that of FIG. 5*f*. However, it differs in that sheets 228 stand vertically, and while members 222, 224 shelter the predominant portion of shelf 124, the sheltered portion being more than a majority of the shelf, and in the embodiment illustrated nearly all of shelf 124, nonetheless, a small lip 132 of shelf 124 protrudes laterally outboard of the shed plate, leaving a small upwardly facing lip. By contrast, in the embodiment of FIG. 5*g*, members 232, 234, while otherwise similar to members 222, 224, have a main sheet portion 236 that is inclined such that the lowermost and outermost corner of members 232, 234 is flush with, or slightly proud of, extremity 126 of margin 120 of bottom flange or cover plate 114. As such, there is no upwardly facing edge, or lip on which downwardly flowing material may catch. The embodiment of FIG. 5*h* is substantially the same as the embodiment of FIG. 5*g*, but differs therefrom to the extent that members 242, 244 have lower corners, or fingers 246, that extend about, and curl around, the outside of extremity 126, and reach under the projection 122 to engage the underside of flange 114.

Noting that welding to the web or to the flanges may not be the best choice, there are alternative embodiments, as explained above. In further alternative embodiments, it may be that in an analogous assembly, items 160, and two items 150 may be manufactured as a single-piece, such as a spring, that may clip into place, and that may also be held at its upper margins or held along its face by fasteners such as fittings 168. Alternatively, an asymmetrical two-piece assembly may be used. In one embodiment, item 160 and one item 150 may be manufactured as a single, generally L-shaped piece. The L-shaped piece may then be joined to a single piece item to make the full three-sided assembly. In another example, a substantially symmetrical two piece assembly may be made by joining one half of 160 and one plate 150 may be formed as a single spring, in the form of an angle. It may be mated at the centerline of the car with a similar part for the opposite side. Tightening may spring load the parts, such that they may tend to stay in place. It is not necessary that the same arrangement of securement of the shed plate be used on both sides of center sill 60. For example, the upper margin of one plate may be secured to a hopper discharge flange, while the plate on the other side of the car is secured to a service conduit. To that extent, the features of the various embodiments shown and described herein may be mixed as may be appropriate.

As has been described, in at least one embodiment there is a structure for a bottom dumping railroad hopper car. The hopper car may have at least a first hopper, that first hopper having a downwardly opening discharge section, the discharge section having an opening through which to discharge lading, the opening having a periphery. The structure has a center sill, the center sill having at least a first shear web and at least a first flange. The shear web stands upwardly of the flange. The flange has a margin extending laterally outboard of the web. The structure includes a wall member that extends upwardly of the margin of the flange. The wall member is located between the flange and the periphery of the discharge opening. At least the majority of the margin of the flange is located in the lee of the wall member.

In a feature of that embodiment, the wall member extends from a height below the periphery of the discharge section opening to a height higher than at least a portion of the periphery of the discharge opening. In another feature, the wall member has an upper margin, and the upper margin of the wall member lies at a greater height than an uppermost portion of the periphery of the opening. In still another feature, the wall member extends from a height below at least a portion of the periphery of the discharge section opening to a height that is above all of the periphery of the discharge opening. In a further feature, substantially all of the flange adjacent to the hopper discharge section is sheltered behind the wall member. In a still further feature, the flange has an outermost distal tip most laterally outboard of the web, and the wall member extends outboard of the distal tip. In yet another feature, the wall member is secured in place other than by weldment to the center sill. In an additional feature, the wall member is secured in place without attachment to the center sill. In still another feature, the wall member is secured to the discharge section of the hopper. In again another feature, the wall member has a curved upper margin that seats about a service delivery conduit. In a yet further feature, at least a portion of the wall member is maintained in position by a retainer that extends at least partially underneath the center sill.

Alternatively, a railroad hopper car has been described herein. In one embodiment it has at least a first hopper. That first hopper has a downwardly opening discharge section. The discharge section has an opening through which to discharge lading. The opening has a periphery. The car has a center sill. The center sill has at least a first shear web and at least a first flange. The shear web stands upwardly of the flange. The flange has a margin extending laterally outboard of the web. The car has a wall member that extends upwardly of the margin of the flange. The wall member is located between the flange and the periphery of the discharge opening. At least a majority of the margin of the flange being located in the lee of the wall member.

That railroad hopper car may be such that the wall member extends from a height below the periphery of the discharge section opening to a height higher than at least a portion of the periphery of the discharge opening. The wall member has an upper margin that lies at a greater height than an uppermost portion of the periphery of the opening. The wall member extends from a height below at least a portion of the periphery of the discharge section opening to a height that is above all of the periphery of the discharge opening. In some embodiments, all of the flange adjacent to the hopper discharge section is sheltered behind the wall member. The wall member may be secured in place other than by weldment to the center sill. That is, the car may be one in which at least one of: (a) the wall member is secured in place without attachment to the center sill; (b) the wall member is secured to the discharge section of the hopper; and (c) the wall member has a curved upper margin that seats about a service delivery conduit. In another feature, at least a portion of the wall member is maintained in position by a retainer that extends at least partially underneath the center sill.

In one or another of the various embodiments described, the wall member has the form of a plate having an angle formed therein such that the wall member has a first portion and a second portion. The first portion defines a first flange of the wall member for engagement with the flange of the center sill, and the flange of the wall is positioned one of (a) on an upper surface of the flange of the center sill; and (b) to curl around the flange and extend at least partially therebelow. The second portion extends upwardly from the first portion, and the second portion has an upper margin that is one of (a) mounted to a portion of the discharge section at a height above any uppermost portion of the periphery of the discharge opening; (b) secured to the center sill other than by welding; (c) is formed to seat about a services conduit; and (d) is formed into a second flange such that the overall member has a channel form, and said second flange is secured to structure other than the center sill.

Various embodiments have been described in detail. Since changes in and or additions to the above-described examples may be made without departing from the nature, spirit or scope of the invention, the invention is not to be limited to those details.

We claim:

1. A railroad hopper car structure for a hopper car having at least a first hopper, that first hopper having a downwardly opening discharge section, the discharge section having an opening through which to discharge lading, said opening having a periphery, said structure comprising:

a center sill, said center sill having at least a first shear web and a first flange;

said first shear web standing upwardly of said first flange;

said first flange having a margin extending laterally outboard of said first shear web; and a wall member extending upwardly of said margin of said first flange, said wall member being located between said first flange and the periphery of the opening of the discharge section, at least the majority of said margin of said first flange being located in the lee of said wall member.

2. The railroad hopper car structure of claim 1, wherein said wall member extends from a height below the periphery of the discharge section opening to a height higher than at least a portion of the periphery of the discharge opening.

3. The railroad hopper car structure of claim 1 wherein said wall member has an upper margin, and said upper margin of said wall member lies at a greater height than an uppermost portion of the periphery of the opening.

4. The railroad hopper car structure of claim 1 wherein said wall member extends from a height below at least a portion of the periphery of the discharge section opening to a height that is above all of the periphery of the discharge opening.

5. The railroad hopper car structure of claim 1 wherein substantially all of said flange adjacent to the hopper discharge section is sheltered behind said wall member.

6. The railroad hopper car structure of claim 1 wherein said flange has an outermost distal tip most laterally outboard of said web, and said wall member extends outboard of said distal tip.

7. The railroad hopper car structure of claim 1 wherein said wall member is secured in place other than by weldment to said center sill.

8. The railroad hopper car structure of claim 1 wherein said wall member is secured in place without attachment to said center sill.

9. The railroad hopper car structure of claim 1 wherein said wall member is secured to the discharge section of the hopper.

10. The railroad hopper car structure of claim 1 wherein said wall member has a curved upper margin that seats about a service delivery conduit.

11. The railroad hopper car structure of claim 1 wherein at least a portion of said wall member is maintained in position by a retainer that extends at least partially underneath the center sill.

12. A railroad hopper car comprising:

at least a first hopper, that first hopper having a downwardly opening discharge section, the discharge section having an opening through which to discharge lading, said opening having a periphery;

a center sill, said center sill having at least a first shear web and a first flange;

said first shear web standing upwardly of said first flange;

said flange having a margin extending laterally outboard of said web; and a wall member extending upwardly of said margin of said flange, said wall member being located between said flange and the periphery of the discharge opening, at least the majority of said margin of said flange being located in the lee of said wall member.

13. The railroad hopper car of claim 12, wherein said wall member extends from a height below the periphery of the discharge section opening to a height higher than at least a portion of the periphery of the discharge opening.

14. The railroad hopper car of claim 12 wherein said wall member has an upper margin, and said upper margin of said wall member lies at a greater height than an uppermost portion of the periphery of the opening.

15. The railroad hopper car of claim 12 wherein said wall member extends from a height below at least a portion of the periphery of the discharge section opening to a height that is above all of the periphery of the discharge opening.

16. The railroad hopper car of claim 12 wherein all of said flange adjacent to said hopper discharge section is sheltered behind said wall member.

17. The railroad hopper car of claim 12 wherein said wall member is secured in place other than by weldment to said center sill.

18. The railroad hopper car of claim 12 wherein at least one of:

(a) said wall member is secured in place without attachment to said center sill;

(b) said wall member is secured to the discharge section of the hopper; and (c) said wall member has a curved upper margin that seats about a service delivery conduit.

19. The railroad hopper car of claim 12 wherein at least a portion of said wall member is maintained in position by a retainer that extends at least partially underneath the center sill.

20. The railroad hopper car of claim 12 wherein:

said wall member has the form of a plate having an angle formed therein such that the wall member has a first portion and a second portion; and said first portion defines a first flange of the wall member for engagement with the flange of the center sill, and said flange of the wall is positioned one of (a) on an upper surface of said flange of said center sill; and (b) to curl around said flange and extend at least partially therebelow;

said second portion extends upwardly from said first portion, and said second portion has an upper margin that is one of (a) mounted to a portion of the discharge section at a height above any uppermost portion of said periphery of said discharge opening;

(b) secured to said center sill other than by welding; and (c) is formed to seat about a services conduit.

21. The railroad hopper car structure of claim 1, the hopper structure having a movable door for mating engagement with the periphery of the discharge section, and wherein said wall member is located in a position in which the door swings past at least a portion of said wall member during opening of the door.

22. The railroad hopper car of claim 12, wherein said first hopper has a movable door operable to mate with the periphery of the discharge section, and when said door opens, said door swings downwardly past at least a portion of said wall member during opening of the door.

* * * * *